US007342468B2

(12) United States Patent
Lopez et al.

(10) Patent No.: US 7,342,468 B2
(45) Date of Patent: Mar. 11, 2008

(54) RF FILTER TUNING SYSTEM AND METHOD

(75) Inventors: Noel A Lopez, Phoenix, AZ (US); Charles E. Woods, Gilbert, AZ (US)

(73) Assignee: U.S. Monolithics, L.L.C., Chandler, AZ (US)

( * ) Notice: Subject to any disclaimer, the term of this patent is extended or adjusted under 35 U.S.C. 154(b) by 31 days.

(21) Appl. No.: 10/906,900

(22) Filed: Mar. 11, 2005

(65) Prior Publication Data

US 2006/0202783 A1 Sep. 14, 2006

(51) Int. Cl.
*H01P 1/20* (2006.01)
*H01P 3/08* (2006.01)

(52) U.S. Cl. ..... 333/202; 333/204; 333/205

(58) Field of Classification Search ..... 333/202, 333/204, 205

See application file for complete search history.

(56) References Cited

U.S. PATENT DOCUMENTS

| | | | | |
|---|---|---|---|---|
| 4,638,271 | A | 1/1987 | Jecko et al. | |
| 6,041,224 | A * | 3/2000 | Wada | 455/327 |
| 6,778,042 | B2 * | 8/2004 | Terashima et al. | 333/205 |
| 2004/0248742 | A1 | 12/2004 | Terashima et al. | |

FOREIGN PATENT DOCUMENTS

| | | |
|---|---|---|
| EP | 0769823 | 4/1997 |
| EP | 1089374 A2 | 4/2001 |
| GB | 2283856 | 5/1995 |
| JP | 03209905 | 9/1991 |
| JP | 08288707 | 11/1996 |
| JP | 09238002 | 9/1997 |
| JP | 11122006 | 4/1999 |

OTHER PUBLICATIONS

International Search Report dated May 10, 2006.

* cited by examiner

*Primary Examiner*—Robert J. Pascal
*Assistant Examiner*—Kimberly E Glenn
(74) *Attorney, Agent, or Firm*—Snell & Wilmer, L.L.P.

(57) ABSTRACT

An apparatus comprises a radio frequency filter and a dielectric material configured to alter the frequency response of the RF filter, wherein said dielectric material is located in proximity to said RF filter. The apparatus may be useful in a satellite antenna system wherein the RF filter is configured to have an initial frequency response. The dielectric material may be configured to shift the frequency response of the RF filter from the initial frequency response to a shifted frequency response. The dielectric material may be a polyimide tape. A method is also provided for reworking a non-compliant PWB, wherein the PWB is non-compliant with a standard frequency response to a given RF input signal, and wherein the PWB comprises an RF filter. The method comprises the step of adjusting the frequency response of the RF filter by adding a piece of polyimide tape in proximity to the RF filter.

17 Claims, 3 Drawing Sheets

RF FILTER TUNING SYSTEM AND METHOD

FIELD OF INVENTION

The field of this invention is primarily directed to altering the frequency response of radio frequency (RF) filters. More specifically, the invention is directed to improving the rate of functional compliancy of printed wire boards (PWB's) by incorporating polyimide tape on or near a RF filter, which in effect reworks a non-compliant PWB.

BACKGROUND OF INVENTION

A PWB often includes an RF filter, such as a high frequency (HF) filter. Because the performance of some RF filters depends on the geometry of the filter layout on the PWB, the performance of such filters may be impacted by the tolerances used to manufacture the filter. I.e., tight tolerances generally increase the likelihood that the manufactured RF filter will meet a specified RF response. For example, a manufacturer may use a tight etching tolerance to create a PWB and the RF filter thereon. However, it is generally more expensive to manufacture PWB's using tight tolerances.

Conversely, it may be less expensive to manufacture a PWB with a looser or more variable tolerance. However, use of such looser tolerances may tend to increase the number of PWBs that do not meet specified performance standards (i.e., again increase the number of non-compliant PWBs). In some instances, such non-compliant PWBs are scrapped, thus effectively reducing the total yield of useful PWBs. In other instances, these non-compliant PWBs can be tuned, or reworked, to bring them into compliance. However, such tuning or reworking of the PWB tends to be expensive and the manufacturer may not realize much of a cost savings over just manufacturing a tighter tolerance PWB.

In regards to tuning, at high frequencies, which is generally considered to comprise frequencies above 500 MHz, a filter's performance may be tuned, for example, by mechanically changing a filter cavity with a screw or by moving one of the surfaces. Even though this type of tuning may shift the RF response, it may compromise the in-band return loss and out-band rejection because the phase and impedance have not been scaled properly. Another method of tuning RF filters is to physically change the size of the resonators by soldering tuning pads, wire bonding to tuning pads, and/or laser trimming. These methods are generally labor intensive and/or require special processes such as wire bonding or laser trimming.

Therefore, a need exists for an improved method of tuning an RF filter, for example, in a PWB. Furthermore, a need also exists for an improved method of reworking a non-compliant PWB.

SUMMARY OF INVENTION

In accordance with an exemplary embodiment, an apparatus comprises a radio frequency filter and a dielectric material configured to alter the frequency response from the RF filter, wherein said dielectric material is located in proximity to said RF filter. In accordance with another exemplary embodiment, a satellite antenna system comprises an antenna unit configured to communicate an RF signal with a satellite and to communicate the RF signal with a transceiver unit, wherein the transceiver unit further comprises an RF filter, and wherein the RF filter is configured to have an initial frequency response. The satellite antenna system also comprises a dielectric material placed in proximity to said RF filter, wherein the dielectric material is configured to shift the frequency response of the RF filter from the initial frequency response to a shifted frequency response. The dielectric material may be a polyimide tape.

In accordance with another exemplary embodiment, a method is provided for reworking a non-compliant PWB, wherein the PWB is non-compliant with a standard frequency in response to a given RF input signal, and wherein the PWB comprises an RF filter, the method comprising the step of adjusting the frequency response of the RF filter by adding a piece of polyimide tape in proximity to the RF filter.

BRIEF DESCRIPTION OF THE DRAWINGS

The subject matter of the invention is particularly pointed out and distinctly claimed in the concluding portion of the specification. A more complete understanding of the invention, however, may best be obtained by referring to the detailed description and claims in connection with the figures, wherein:

DETAILED DESCRIPTION

The following description is of various exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth in the appended claims. For example, in the context of the invention, the apparatus hereof may find particular use in connection with improving the production yield of manufactured PWB's. In one example, polyimide tape is applied to or in the vicinity of a RF filter to bring a PWB unit within compliant quality standards. However, generally speaking, other configurations that bring PWB units into quality compliance may be suitable for use in accordance with the invention.

Figure 1:
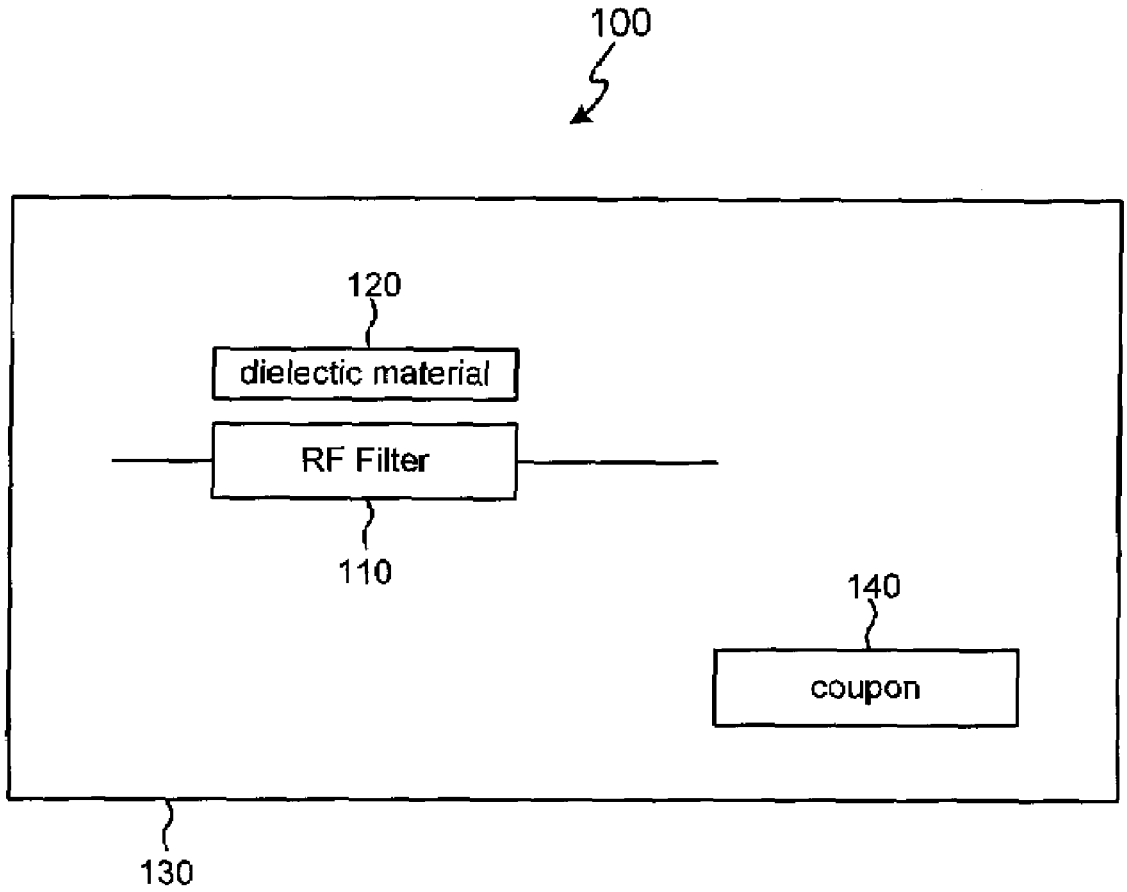
FIG. 1 illustrates an exemplary perspective view of an exemplary high frequency RF filter, PWB, and polyimide tape, in accordance with an exemplary embodiment of the invention.

In accordance with an exemplary embodiment of the invention, and with reference to FIG. 1, an RF filter 110 may be tuned by placing a dielectric material 120 in proximity to RF filter 110. In various exemplary embodiments, RF filter 110 is part of a PWB 130. Furthermore, as described in further detail herein, dielectric material 120 is, in one exemplary embodiment, a polyimide tape.

Radio Frequency (RF) filter 110 may be configured, for example, to pass or attenuate certain frequencies to tune a signal. For example, RF filter 110 may be configured to filter signals within frequencies of certain ranges (pass bands) or may be configured to suppress signals of frequencies within certain ranges (attenuation bands). The frequencies that define upper and lower limits of the pass bands and attenuation bands are referred to as cut-off frequencies. The bandwidth of a band pass or attenuation band filter is the difference between the upper and lower limit frequencies, or cut-off frequencies. For example, a band pass type filter may allow only signal frequencies between, for example, 20-30 GHz to pass and reject all others. An attenuation band type filter on the other hand, may allow all frequencies to pass except, for example, frequencies between 20-30 GHz signals.

It should be appreciated that although exemplary embodiments of the invention may be described herein in terms of pass bands and attenuation bands, other types of RF filters exist and may fall under the ambit of the description detailed herein. For example, RF filter 110 may be configured to allow all signal frequencies to pass above a certain threshold (high pass filters), or to allow all signal frequencies to pass up to a certain threshold (low pass filters). Moreover, RF filter 110 may be generally classified according to the range of its pass band or attenuation band, and can be referred to as a low or high pass filter. High frequency (HF) is typically understood to refer to frequencies greater than 500 MHz, for example, some exemplary embodiments described herein were tested at 14 GHz. In an exemplary embodiment, other frequencies known in the art may be filtered by RF filter as described herein, for example, intermediate frequencies (IF), local oscillating frequencies (LO), ultra-high frequencies (UHF), etc.

In accordance with one aspect of an exemplary embodiment of the invention, RF filter 110 may comprise a passive RF filter. A passive RF filter may be constructed, for example, from impedances. The impedances may be arranged, for example, in shunt and/or in parallel. In accordance with an exemplary embodiment of the invention, a system and method are provided to alter the frequency response of a passive and/or active RF filters. The frequency response of the filter may be adjusted by affecting the impedance structure of the filter. However, it should be appreciated that the invention may be applicable to any distributed matching network, for example the invention may be used to shift the frequency response in the output match of a power amplifier.

In accordance with another aspect of an exemplary embodiment of the invention, RF filter 110 may be associated with a PWB 130. PWB may comprise a dielectric material. In various exemplary embodiments, RF filter 110 forms an integral part of PWB 130. For example, RF filter 110 may be manufactured with PWB 130. In other embodiments, RF filter 110 is supported by PWB 130. Furthermore, PWB 130 may comprise any structure that is suitable for supporting electronic components.

PWB 130 may comprise, for example, a fiberglass (glass epoxy), paper epoxy, bakelite plastic, and/or the like material. PWB 130 may be drilled with a regular pattern of holes. In another embodiment, PWB 130 may be custom fabricated based on the architecture of the designed circuitry. On one side of PWB 130 and centered around each hole there may be a copper layered "land" or "pad." In this configuration, components may be electrically connected to the board by placing the component leads through the holes and wiring the leads to the copper layered "land." In one exemplary embodiment, PWB 130 is a RO4003, manufactured by Rogers Corporation.

All that being said, a PWB and/or RF filter may be manufactured which does not comply with pre-determined quality control (QC) standards. For example, one exemplary quality control standard may set forth a PWB etch feature tolerance of ±0.0005". Another exemplary QC standard is a metal/trace thickness of 0.002"±0.0005". The QC standard, whatever it may be, can affect the filter performance. Thus, non-compliancy may refer to a PWB that does not meet specified dimensional tolerances. Non-compliancy may also refer to a particular RF filter, for example in a PWB, which does not filter the proper frequencies according to design. As an economical alternative to discarding the device and manufacturing another, the frequency response may be appropriately shifted, or brought within the proper designed frequency range.

An exemplary system and method are configured to apply a material to or in the vicinity of a RF filter to shift the frequency response of the RF filter. In one exemplary embodiment, the 'shift' may bring a non-compliant PWB into compliancy. In accordance with an exemplary embodiment, the frequency response may be shifted by applying a self-adhesive dielectric material on or near the RF filter.

The material applied on or near RF filter 110 may be a dielectric material that is configured to alter the response of RF filter 110. For example, in accordance with an exemplary embodiment, the dielectric material is a polyimide tape 120. Polyimide tape 120 may be applied on or adjacent to RF filter 110. Polyimide tape 120 may be configured to shift the frequency response of RF filter 110 by dielectrically loading RF filter 110. In accordance with various aspects of the invention, the frequency response is shifted by an amount that is related to the amount and proximity of polyimide tape 120 to RF filter 110. The mechanism for shifting RF filter 110 is by dielectric loading both the phase and impedance scale by an appropriate amount. Thus, in exemplary embodiments, polyimide tape 120 may be applied in varying amounts, and the frequency response may therefore be adjusted to various degrees.

Figure 2:
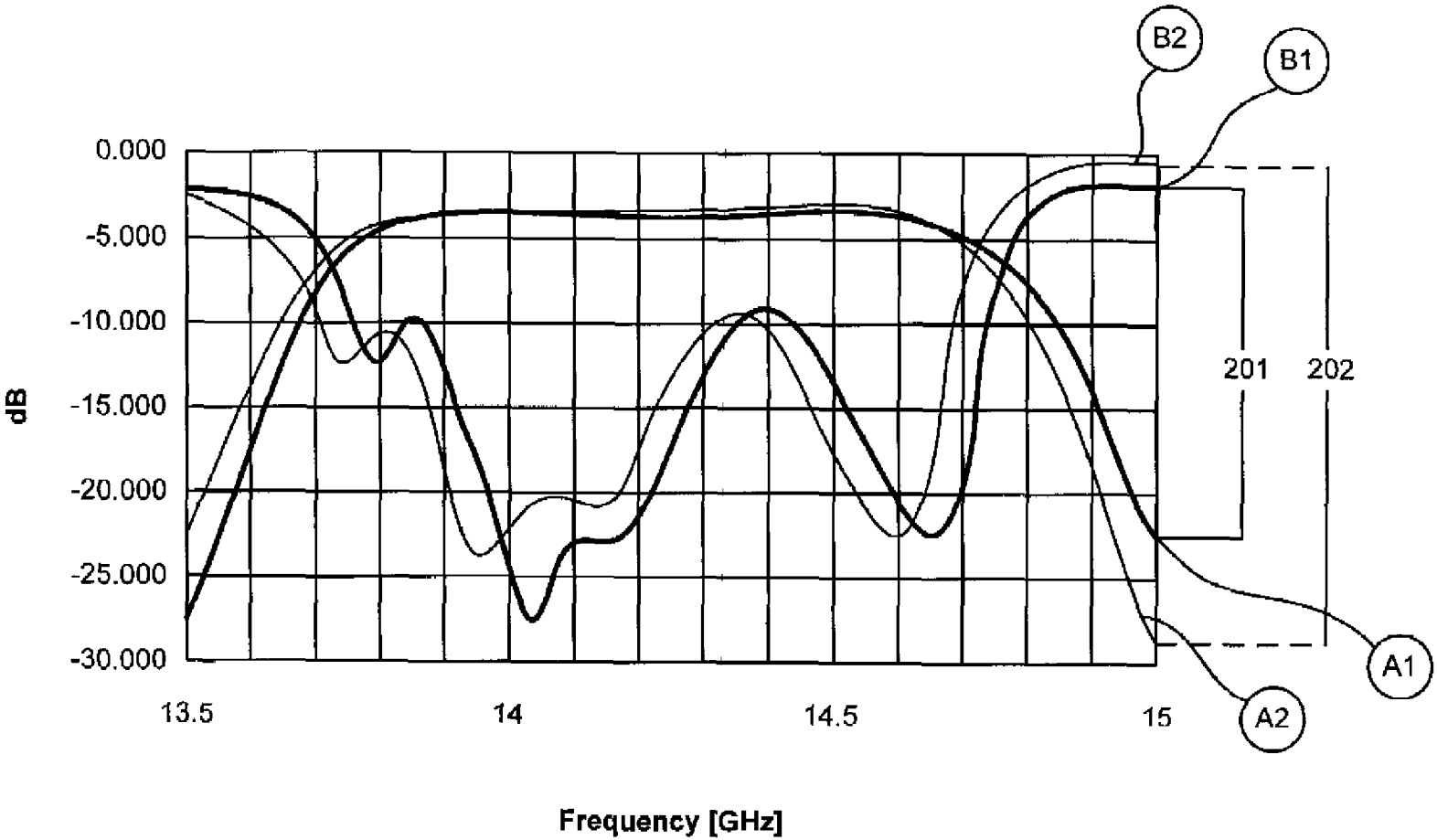
FIG. 2 is a graph that illustrates exemplary frequency responses as between RF filters and RF filters that have been reworked with a polyimide tape, in accordance with an exemplary embodiment of the invention.

FIG. 2 illustrates, in an exemplary embodiment, plotted frequency responses by a RF filter. As discussed herein, a frequency response comprises the signal emanating from the RF filter (shown here, for example, measured in decibels at a particular frequency). For example, a band pass RF filter may filter an incoming signal and output a filtered RF signal. Lines "A1" and "A2" illustrate exemplary RF frequency responses. Line "A1" shows an exemplary RF frequency response of about −22.0 decibels at 15 GHz, and line "A2" shows a frequency response of about −29 decibels at 15 GHz.

In an exemplary embodiment, an RF frequency response shift is illustrated. This shifting may comprise, for example, lowering the high pass cut-off frequency, the low pass cut-off frequency, and/or both. In various embodiments, a shifted RF frequency response may result in a narrower, or similar band width, when compared to the initial (non-shifted) RF frequency response. For example, Lines "A1" and "A2" illustrate that the frequency response has been shifted from line A1 to line A2. Moreover, Lines "B1" and "B2" illustrates yet another method of evaluating the ability of an RF filter to filter a signal. Lines "B1" and "B2" illustrate the amount of the RF signal that is reflected (not passed) by the filter. Here again, Line "B1" represents a non-shifted response and Line "B2" represents a shifted response. In one exemplary aspect of the invention, Lines "A1" and "B1" represent the response of a non-compliant PWB board and Lines "A2" and "B2" represents a RF filter response that has been tuned by application of polyimide tape.

In an exemplary embodiment of the invention, a method of reworking a device comprises applying a material to a component of an electronic device, wherein the application of the material alters the frequency response filtered by the component of the electronic device. In an exemplary embodiment of the invention, the material is a dielectric material. For example, the dielectric material may be a polyimide tape.

Figure 3:
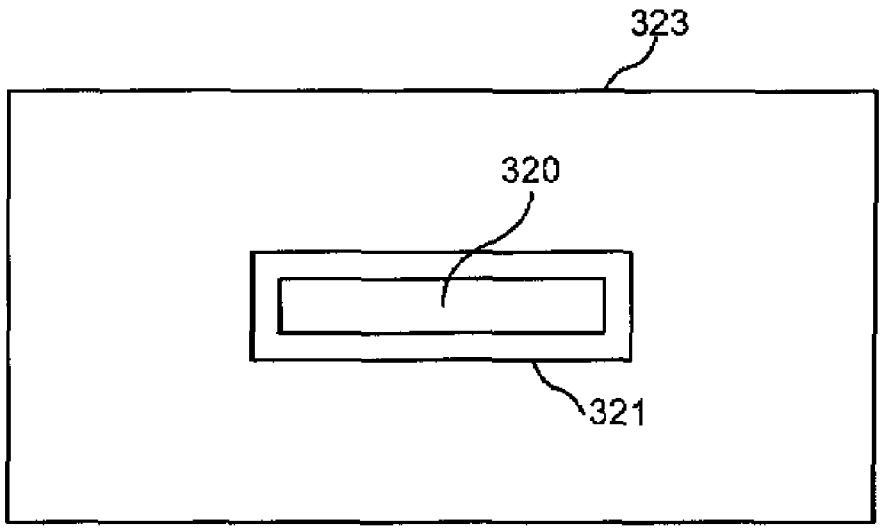
FIG. 3 illustrates an exemplary polyimide tape applied to a high frequency RF filter, in accordance with an exemplary embodiment of the invention.
Figure 3:
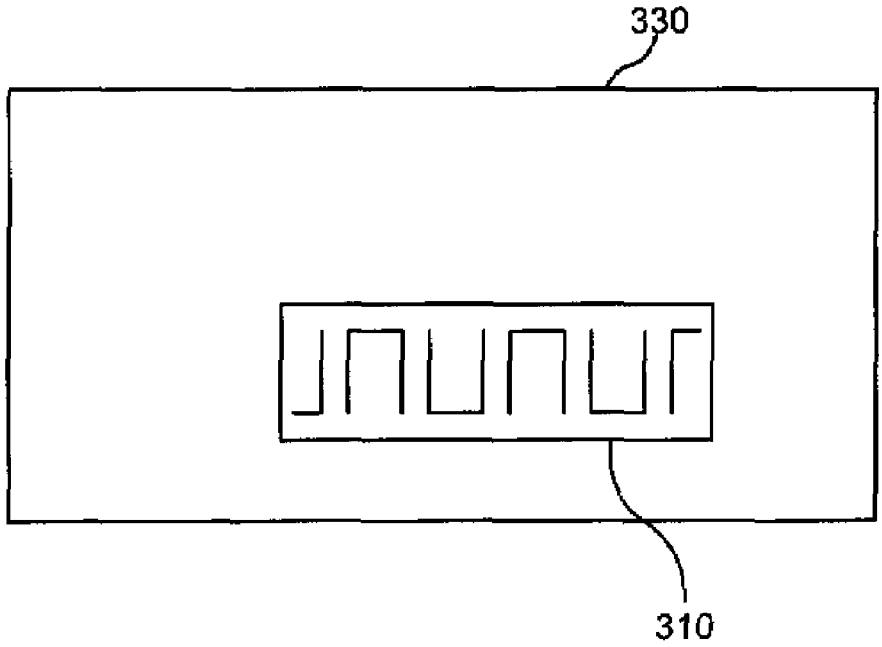

Thus, in accordance with an exemplary embodiment, and with reference to FIG. 3, a polyimide tape 320 is configured to alter the frequency response of an RF filter. The polyimide tape may be configured to act as a passive element added to RF filter 110 to adjust the frequency response. One example of polyimide tape that may be commonly used comprises Bertech-Kelex part number KPT-¼, or 3M part number Electrical Tape 92. The polyimide tape may, for example, be sold under the trademark Kapton by DuPont. Although described herein as a polyimide tape, it should be appreciated that the dielectric material may comprise any material(s) that exhibits dielectric properties that may be configured to adjust the frequency response of an RF filter.

In accordance with various aspects of the invention, the amount that the RF frequency response is shifted may depend on the amount and geometry of the dielectric material (various examples herein described in terms of a polyimide tape may nonetheless also apply in general to a dielectric material). For example, polyimide tape 220 may comprise a material that ranges from about 1 mil to about 5 mils thick, however, it should be appreciated that thicker or thinner material may be used. The thickness may vary depending on the part number of polyimide tape used, or depend on a different type of dielectric altogether. Furthermore, varying thicknesses may be selected to cause a desired impact on the frequency response, and one or more layers of polyimide tape may be used to increase the impact on the frequency response.

In addition, the width and/or length of the polyimide tape may be varied. A narrower tape may, for example, have less impact on the frequency response than a wider tape. Furthermore, the polyimide tape need not be a rectangular shape, and other shapes and patterns may be provided in a polyimide tape to impact the frequency response.

Also, the distance between the polyimide tape and the RF filter may affect the degree to which the frequency response of the RF filter is tuned. For example, the polyimide tape may be adhered directly over the RF filter. In another exemplary embodiment, the polyimide tape may be adhered to a component that is placed over the RF filter. For example, polyimide tape 320 may be adhered to the underside of top portion 323 within cavity 321 and top portion 323 may be configured to be placed over PWB 330 such that cavity 321 substantially aligns over RF filter 310. In this manner, polyimide tape 320 may be placed in proximity to, though in this case not adhered to, RF filter 310. Also, polyimide tape 320 may be placed under RF filter 310, such as in a suspended stripline embodiment. Although in some embodiments, polyimide tape 320 may be configured to be directly over RF filter 310, in other embodiments, polyimide tape may be offset from RF filter 310. For example, polyimide tape may be in a plane parallel to and above the plane in which RF filter 310 lies, but only partially covering or above RF filter 310. Furthermore, polyimide tape 310 may be adhered in a location that does not cover RF filter 310 at all. In short, polyimide tape may be located in any location that is proximate to RF filter. In one example, on a micro-strip, the polyimide tape is located within 5 PWB substrate thicknesses away from the RF filter. However, the polyimide tape may be placed greater distances from the RF filter. Further more, "proximate" may vary from one device to another, and generally is a distance suitable for substantially impacting the RF frequency response of an RF filter.

Although polyimide tape is convenient as it may be readily adhered proximate to an RF filter, and can be removed with ease as well, other materials may be applied in proximity to RF filter 310 using other methods. For example, a dielectric material may be sprayed on to RF filter 310. In yet another example, dielectric materials can also be fluids or gases, and applied in various manners configured to shift the frequency response of RF filter 310.

As explained earlier, a non compliant PWB may contribute to a RF filter not filtering the proper range of signals, i.e. not filtering the designed range of frequencies. The invention provides a cost effective solution to bring such PWB's into compliancy. Furthermore, in one aspect of the invention, it may be beneficial to determine how much of the dielectric material to apply. In an exemplary embodiment of the invention, empirical methods may be employed to determine how much material to apply to alter the frequencies filtered by the RF filter. By employing an empirical method, a user may determine through trial and error, in one aspect, to add the material directly to the RF filter. In another aspect, a user may determine to add the material adjacent to the RF filter. In determining the proper amount of material to use, the user may determine whether to apply it in a single strip or to layer the material in multiple strips.

For example, one empirical method comprises, first measuring or determining a baseline response at a particular frequency. The baseline is used as a reference point to evaluate adjustments in the frequency response upon addition of the dielectric, in this case, the polyimide tape. Next, a user compiles pieces of tape comprising increasing size and/or thicknesses. Each tape piece is then placed upon the filter and the frequency response is measured to determine the shift in the signal. Subsequent pieces are added and the responses measured. Next, in Excel for example, a user creates a "look up" table from the obtained data, and executes a best polynomial fit to the data to derive an empirical function of frequency shift/rejection as a function of size, thickness, or proximity of the dielectric. It may be appreciated that some data points may be interpolated to facilitate the method.

In another exemplary embodiment, rather than carrying out empirical testing, a user may employ computer modeling techniques, to predict the frequency response of the material enhanced RF filter. In accordance with an exemplary embodiment of the invention, an RF frequency response is measured and compared to an expected result. Based on the difference between the measured response and the expected response, a dielectric material is selected, the appropriate amount of that material is also selected (e.g., width, number of layers, and/or the like), and the placement of that material relative to the RF filter is selected. These selections may be based on results from computer modeling, for example, from an EM simulator using HFSS 3-D software. Similar to the empirical method described above, various tape sizes, thicknesses, widths, etc., may be investigated. As opposed to measuring actual physical results as in the empirical method, the simulator would provide results, and again, a "look-up" table wherein data is compiled, plotted, and subsequently used to create a plot. A best fit line is applied and the appropriate polynomial function determined to formulate frequency shift/rejection as a function of size, thickness, or proximity of the dielectric.

In an exemplary method of the invention, it may be beneficial to test the frequency response of RF filters on a PWB before constructing devices on the PWB. In one embodiment, and with reference to FIG. 1, a coupon 140 is embedded in PWB 130. Coupon 140 may comprise a test RF filter. A user may measure the frequency response of the test RF filter on coupon 140. The response of the coupon is configured to generally correlate to the frequency response of other RF filters on PWB 130. If the coupon RF filter is tested and determined to be non-compliant, that is, the frequency response is not as designed, material may be applied to the coupon (as well as other RF filters on PWB 130) in accordance with the invention described herein. The material described may be added by an appropriate amount where the appropriate amount may be determined by an empirical or modeling method, as mentioned previously. The coupon may be tested again after the application of polyimide tape 120, and the process repeated (adding or subtracting tape to the RF filter. A similar process may be conducted on the other RF filters before or after components have been added to the PWB.

Lastly, various principles of the invention have been described in exemplary, illustrative embodiments. However, many combinations and modification of the above-described structures, arrangements, proportions, elements, materials and components, used in the practice of the invention, in addition to those not specifically described, may be varied and particularly adapted to specific environments and operating requirements without departing from those principles.

What is claimed is:

1. An apparatus comprising, a transceiver, said transceiver further comprising:

a radio frequency (RF) filter and a substrate, said RF filter comprising at least a portion of said substrate;

a component configured to be placed over said RF filter; and a material comprising a dielectric material configured to reduce the reject rate of said substrate by modifying the characteristics of said substrate by altering the frequency response of said RF filter, wherein said material is affixed to a surface of said component, wherein said surface is spaced apart from said substrate, and wherein said material is spaced a fixed distance from said substrate.

2. The apparatus of claim 1, wherein said material further comprises a self adhesive polyimide tape.

3. The apparatus of claim 1, wherein said material is affixed to the underside of said component such that it is located between said component and said substrate, and wherein said material is not in contact with said substrate.

4. The apparatus of claim 2, wherein said polyimide tape is configured to shift the frequency response of said RF filter by at least 1 Hz.

5. An apparatus comprising, a radio frequency (RF) filter;

a substrate, wherein said filter is a part of said substrate;

a component configured to cover said filter; and a dielectric material configured to rework said substrate by altering the frequency response of said RF filter, wherein said dielectric material is self adhesively affixed to said component, and said dielectric material is spaced a fixed distance apart from said RF filter.

6. The method of claim 5, wherein said RF filter comprises one of an HF filter, an IF filter, and an LO filter, and wherein said polyimide tape is configured to shift the frequency response of said RF filter by at least 1 Hz.

7. A method for reducing the reject rate of Printed Wiring Boards (PWB's), wherein said PWB comprises a radio frequency (RF) filter, said method comprising the steps of:

testing a PWB, wherein said testing comprises providing an input test signal to the PWB, measuring an output signal from the PWB, comparing said output signal to a standard response, and determining the PWB's compliancy with said standard response based on the results of said comparing step; and locating a polyimide tape in proximity to, but spaced a fixed distance apart from, said RF filter, wherein said polyimide tape is applied to the underside of a fixed structure that is configured to be placed over said RF filter, and wherein said locating step is configured to convert a non-compliant PWB to a compliant PWB due to altering the frequency response of said RF filter.

8. The method of claim 7, wherein said RF filter comprises one of an HF filter, an IF filter, and an LO filter.

9. The method of claim 7, wherein said polyimide tape is a self-adhesive polyimide tape, wherein said locating step further involves the step of determining, based on said testing step, at least one of the following dimensions of said polyimide tape to be used in order to bring said RF filter into compliancy:

(i) a width of said polyimide tape, (ii) a thickness of said polyimide tape, and (iii) a number of layers of said polyimide tape.

10. A satellite antenna system comprising, an antenna unit configured to communicate an RF signal with a satellite and to communicate said RF signal with a transceiver unit, wherein said transceiver unit further comprises an RF filter, and wherein said RF filter is configured to have an initial frequency response;

a structure located over said substrate; and a dielectric material supported by said structure and spaced a fixed distance apart from said RF filter, and wherein said dielectric material is configured to cause a non-compliant PWB to become compliant by shifting the frequency response of said RF filter from said initial frequency response to a shifted frequency response.

11. The system of claim 10, wherein said RF filter comprises at least one of a high frequency (HF) RF filter, an intermediate frequency (IF) RF filter, and a local oscillator (LO) RF filter.

12. The apparatus of claim 10, wherein said dielectric material is affixed to the underside of said structure such that it is located between said structure and said RF filter, and wherein said dielectric material is not in contact with said RF filter.

13. The apparatus of claim 10, and wherein said dielectric material comprises a self-adhesive polyimide tape.

14. The apparatus of claim 10, wherein said self-adhesive polyimide tape is configured to shift the frequency response of said RF filter by at least 1 Hz.

15. A method for reworking a non-compliant PWB, wherein said PWB is non-compliant with a standard frequency response to a given RF input signal, and wherein said PWB comprises an RF filter, the method comprising the steps of:

determining that a frequency response of a non-compliant PWB is non-compliant with a predefined standard for frequency responses; and adjusting the frequency response of said RF filter to reduce the reject rate of said non-compliant PWB, wherein said adjusting step further comprises the step of selecting the dimensions of a piece of self adhesive polyimide tape and placing said polyimide tape in proximity to, but spaced a fixed distance apart from and not supported on, said RF filter, and wherein said adjusting is based on the degree of the noncompliance.

16. A method for tuning the frequency response of an RF filter located on a PWB in order to reduce the rejection rate of a non-compliant PWB, said method comprising the steps of:

applying a self adhesive polyimide tape to a surface of a structure, the dimensions of said polyimide tape determined by the desired degree of tuning, wherein said structure is in proximity to said RF filter and configured to hold said self adhesive polyimide tape spaced a fixed distance apart from the RF filter, wherein said applying step is configured to tune the frequency response of the RF filter in order to reduce the rejection rate of said non-compliant PWB.

17. The method of claim 16, wherein a set of PWBs have consistent characteristics, wherein said polyimide tape is applied to said set of PWBs in a consistent manner based upon said testing step configuration, wherein said testing step configuration is performed on less than all of said set of PWBs.

* * * * *

UNITED STATES PATENT AND TRADEMARK OFFICE

CERTIFICATE OF CORRECTION

PATENT NO. : 7,342,468 B2
APPLICATION NO. : 10/906900
DATED : March 11, 2008
INVENTOR(S) : Noel A. Lopez and Charles E. Woods It is certified that error appears in the above-identified patent and that said Letters Patent is hereby corrected as shown below:

Column 8, line 51 cancel the text "The apparatus of claim 10, wherein said self-adhesive" and replace with --The apparatus of claim 13, wherein said self-adhesive--.

Column 10, line 5 cancel the text "17. The method of claim 16, wherein a set of PWBs have" and replace with --17. The method of claim 7, wherein a set of PWBs have--.

Signed and Sealed this

Seventeenth Day of June, 2008

JON W. DUDAS
*Director of the United States Patent and Trademark Office*